US006691594B2

(12) United States Patent
Chen

(10) Patent No.: US 6,691,594 B2
(45) Date of Patent: Feb. 17, 2004

(54) WRENCH STRUCTURE

(76) Inventor: Terence Chen, No. 325 Yungching Road, Dungshan Shiang Ilan (TW)

( * ) Notice: Subject to any disclaimer, the term of this patent is extended or adjusted under 35 U.S.C. 154(b) by 57 days.

(21) Appl. No.: 10/189,487

(22) Filed: Jul. 8, 2002

(65) Prior Publication Data

US 2004/0003684 A1 Jan. 8, 2004

(51) Int. Cl.[7] ..... B25B 13/46
(52) U.S. Cl. ..... 81/61; 81/62
(58) Field of Search ..... 81/61, 62, 63.1; 192/43.1

(56) References Cited

U.S. PATENT DOCUMENTS 2,201,827 A * 5/1940 Froeschl et al. ..... 81/63.1
3,436,992 A * 4/1969 Over et al. ..... 81/63.1
2002/0026858 A1 * 3/2002 Hu ..... 81/63.1

* cited by examiner

*Primary Examiner*—James G. Smith
(74) *Attorney, Agent, or Firm*—Rosenberg, Klein & Lee

(57) ABSTRACT

A wrench structure includes a wrench handle, a drive body, two directional blocks, and a direction control member. The wrench handle has a drive head formed with a receiving chamber for mounting the drive body and a guide slot for mounting each of the two directional blocks. The drive head has an end face formed with a direction control recess and a spacing portion located between the receiving chamber and the direction control recess, for enhancing the structural strength of the wrench handle. The direction control recess is formed with a limit portion for limiting and guiding each of the two directional blocks, so that each of the two directional blocks may be moved to a determined position exactly, thereby changing the direction of operation of the wrench handle and the drive body actually.

9 Claims, 5 Drawing Sheets

WRENCH STRUCTURE

BACKGROUND OF THE INVENTION

1. Field of the Invention

The present invention relates to a wrench structure, and more particularly to a wrench structure that is provided with a spacing portion located between the receiving chamber and the direction control recess, for enhancing the structural strength of the wrench handle.

2. Description of the Related Art

A conventional wrench structure in accordance with the prior art comprises a wrench body, a drive device, two locking blocks, and a control disk. The wrench body is formed with a central through hole which is formed with a receiving recess and a locking recess communicating with the receiving recess. The drive device is mounted in the central through hole of the wrench body. Each of the two locking blocks is mounted in the receiving recess of the wrench body, and is engaged with the drive device. A spring is mounted between the two locking blocks. Each of the two locking blocks has a locking stub. The control disk is mounted in the locking recess of the wrench body, and is formed with a driving hole for driving the locking stub of one of the two locking blocks. Thus, the control disk may be rotated to pivot one of the two locking blocks to mesh with the drive device.

However, the conventional wrench structure has the following disadvantages.

1. The wrench body is divided by the central through hole, the receiving recess and the locking recess, so that the surface of the wrench body is disposed at a broken state, and the stress is easily concentrated on the surface of the wrench body, thereby decreasing the structural strength of the conventional wrench handle.

2. The locking stub of each of the two locking blocks is controlled by the driving hole of the control disk. The driving hole of the control disk cannot retain the locking stub of each of the two locking blocks efficiently, so that each of the two locking blocks cannot be moved be lock the drive device exactly, thereby affecting the efficiency of operation of the conventional wrench structure.

SUMMARY OF THE INVENTION

The present invention has arisen to mitigate and/or obviate the disadvantage of the conventional wrench structure.

The primary objective of the present invention is to provide a wrench structure that is provided with a spacing portion located between the receiving chamber and the direction control recess, for enhancing the structural strength of the wrench handle.

Another objective of the present invention is to provide a wrench structure, wherein the direction control recess is formed with a limit portion for limiting and guiding each of the two directional blocks, so that each of the two directional blocks may be moved to a determined position exactly, thereby changing the direction of operation of the wrench handle and the drive body actually.

In accordance with the present invention, there is provided a wrench structure, comprising a wrench handle, a drive body, two directional blocks, and a direction control member, wherein:

the wrench handle has a distal end provided with a drive head, the drive head is formed with a receiving chamber and a guide slot communicating with the receiving chamber, the drive head has an end face formed with a direction control recess and a spacing portion located between, the receiving chamber and the direction control recess, the direction control recess has a bottom wall formed with a limit portion communicating with the guide slot;

the drive body is mounted in the receiving chamber of the drive head of the wrench handle;

each of the two directional blocks is pivotally mounted in the guide slot of the drive head of the wrench handle and is provided with a protruding guide portion extended through the limit portion and extended into the direction control recess; and the direction control member is rotatably mounted in the direction control recess of the drive head of the wrench handle and is rested on the guide portion of each of the two directional blocks, for pivoting and moving each of the two directional blocks in the guide slot of the drive head of the wrench handle.

Further benefits and advantages of the present invention will become apparent after a careful reading of the detailed description with appropriate reference to the accompanying drawings.

DETAILED DESCRIPTION OF THE INVENTION

Figure 1:
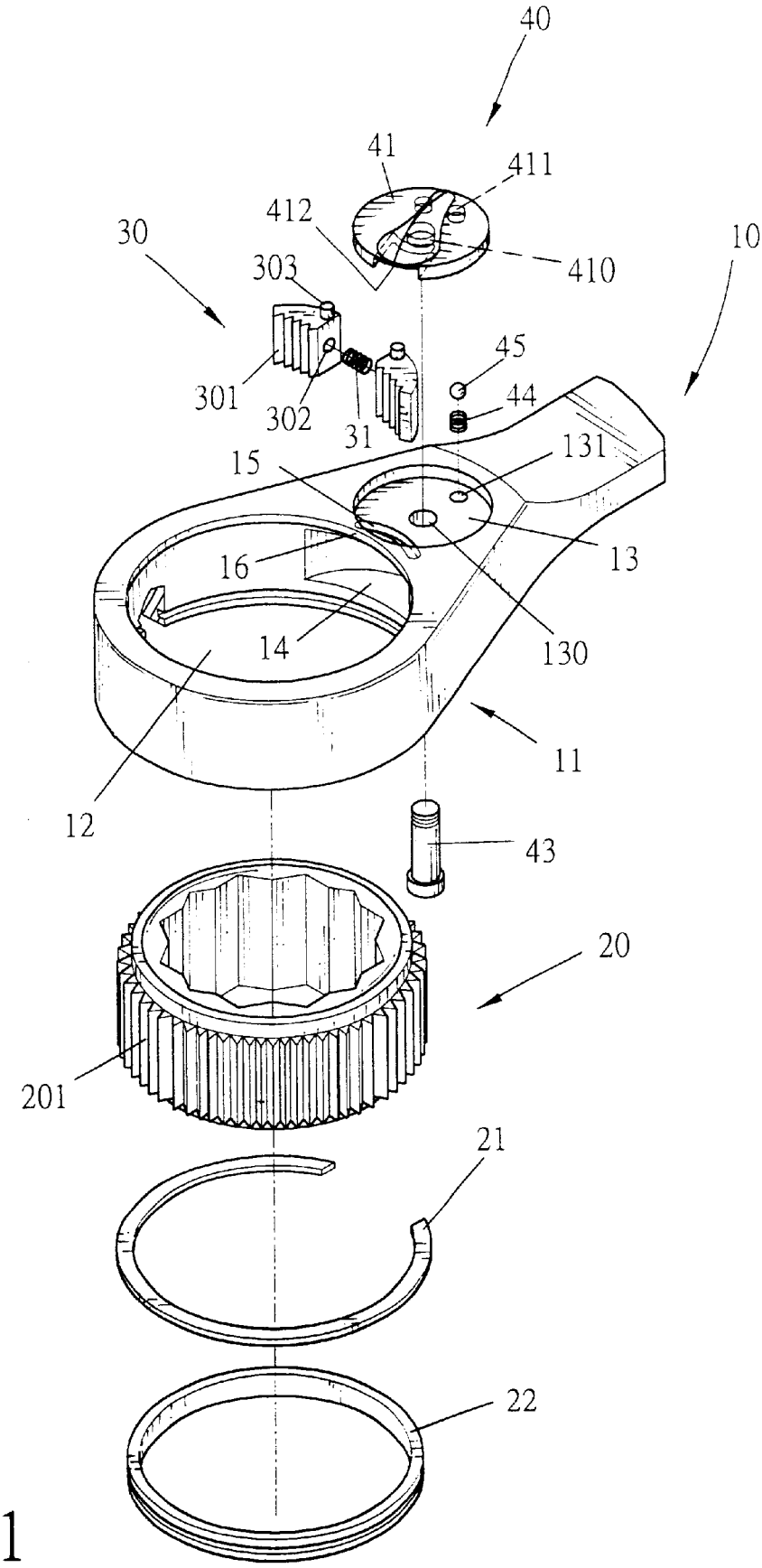
FIG. 1 is an exploded perspective view of a wrench structure in accordance with a preferred embodiment of the present invention.
Figure 2:
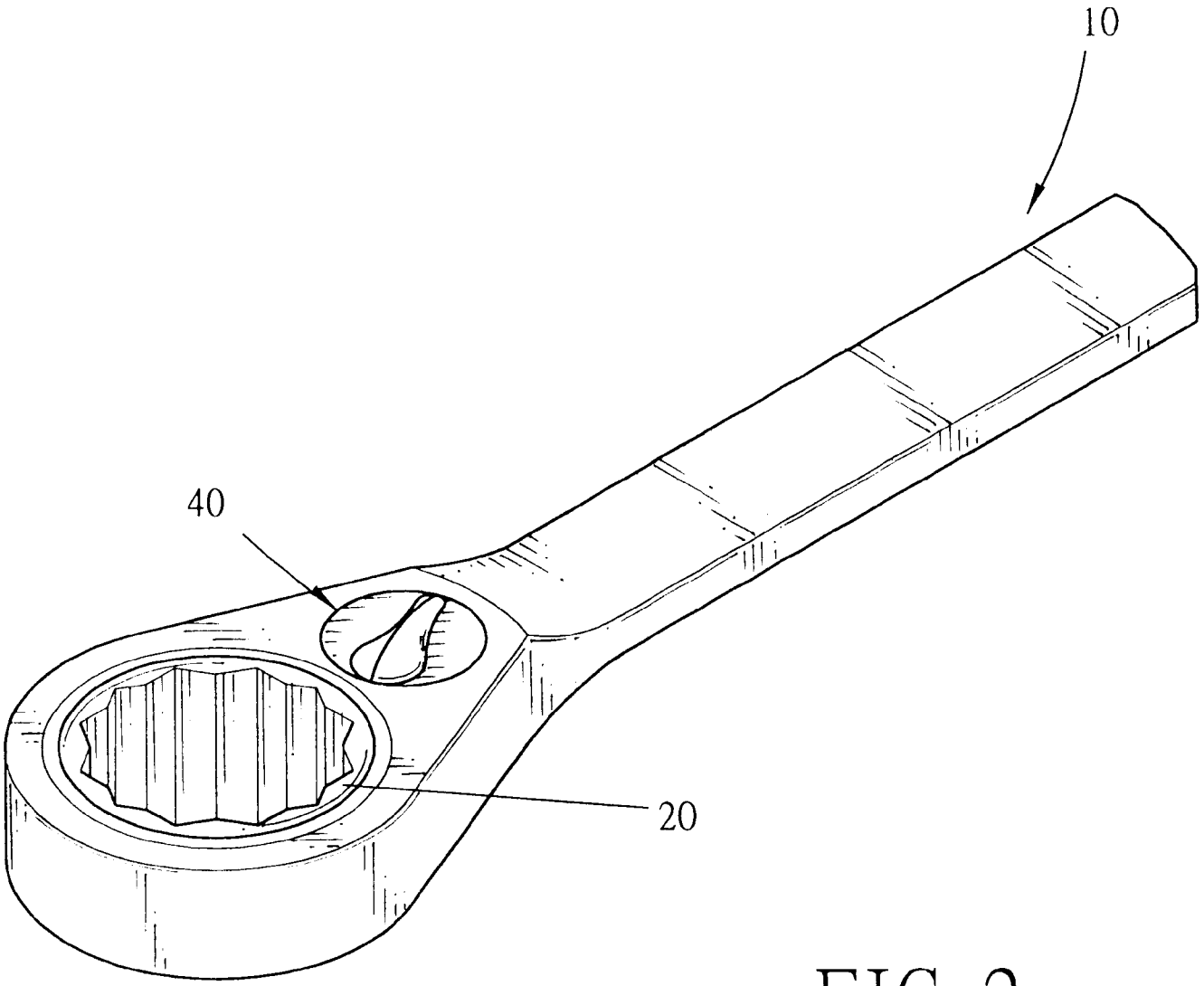
FIG. 2 is a perspective assembly view of the wrench structure in accordance with the preferred embodiment of the present invention.
Figure 3:
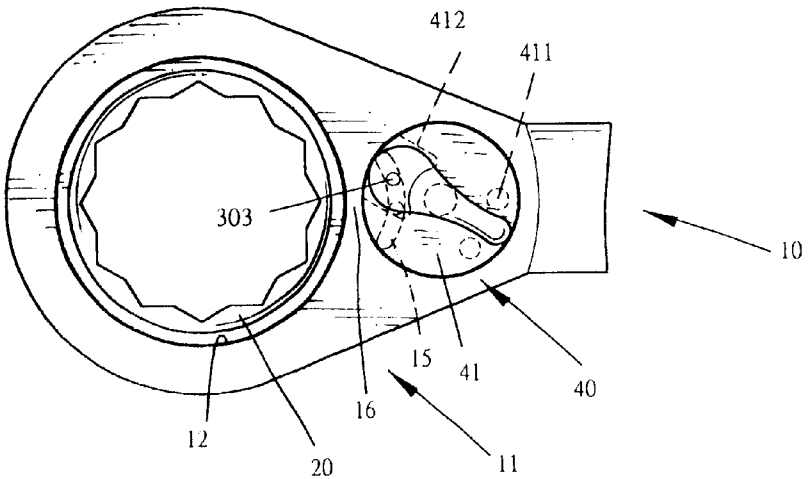
FIG. 3 is a top plan operational view of the wrench structure as shown in FIG. 2.

Referring to the drawings and initially to FIGS. 1–3, a wrench structure in accordance with a preferred embodiment of the present invention comprises a wrench handle 10, a drive body 20, two directional blocks 30, and a direction control member 40.

The wrench handle 10 has a distal end provided with a drive head 11. The drive head 11 of the wrench handle 10 is formed with a receiving chamber 12 for mounting the drive body 20. The drive body 20 may be retained in the receiving chamber 12 of the drive head 11 of the wrench handle 10 by a C-shaped snap ring 21 and a stop ring 22. The drive body 20 has an outer wall provided with multiple ratchet teeth 201. The drive head 11 of the wrench handle 10 has an end face formed with a direction control recess 13 located adjacent to the receiving chamber 12 of the drive head 11 of the wrench handle 10. The end face of the drive head 11 of the wrench handle 10 is formed with a spacing portion 16 located between the receiving chamber 12 and the direction control recess 13 of the drive head 11 of the wrench handle 10. The spacing portion 16 of the drive head 11 of the wrench handle 10 is continuous extended and is not broken, so that the structure of the end face of the drive head 11 of the wrench handle 10 is not broken, thereby efficiently preventing the stress from being concentrated on the portion between the receiving chamber 12 and the direction control recess 13 of the drive head 11 of the wrench handle 10. An arcuate guide slot 14 is formed in the drive head 11 of the wrench handle 10, and is located between the receiving chamber 12 and the direction control recess 13 of the drive head 11 of the wrench handle 10.

Each of the two directional blocks 30 is pivotally mounted in the arcuate guide slot 14 of the drive head 11 of the wrench handle 10, and an elastic push member 31 is mounted between the two directional blocks 30. Each of the two directional blocks 30 has one end formed with a receiving hole 302 for receiving the elastic push member 31. Each of the two directional blocks 30 has one side provided with a tooth-shaped locking portion 301 that may mesh with the multiple ratchet teeth 201 of the drive body 20. Each of the two directional blocks 30 has a top face provided with a stub-shaped guide portion 303 that may be extended into the direction control recess 13 of the drive head 11 of the wrench handle 10. The direction control recess 13 of the drive head 11 of the wrench handle 10 has a bottom wall formed with an arcuate slotted limit portion 15 communicating with the arcuate guide slot 14 of the drive head 11 of the wrench handle 10. Thus, the guide portion 303 of each of the two directional blocks 30 may be extended into the limit portion 15 of the direction control recess 13 of the drive head 11 of the wrench handle 10.

The direction control member 40 includes a disk-shaped body 41 rotatably mounted in the direction control recess 13 of the drive head 11 of the wrench handle 10. The direction control recess 13 of the drive head 11 of the wrench handle 10 is formed with a central hole 130. The body 41 of the direction control member 40 is formed with a fixing hole 410. A fixing bolt 43 is extended through the central hole 130 of the direction control recess 13 of the drive head 11 of the wrench handle 10, and is secured in the fixing hole 410 of the body 41 of the direction control member 40, so that the direction control member 40 is rotatably mounted in the direction control recess 13 of the drive head 11 of the wrench handle 10. The body 41 of the direction control member 40 has a periphery formed with two spaced positioning holes 411. The direction control recess 13 of the drive head 11 of the wrench handle 10 has a periphery formed with a receiving hole 131 for receiving a spring-shaped elastic member 44 and a ball-shaped positioning member 45. The positioning member 45 may be pushed by the elastic member 44 to be locked in one of the two spaced positioning holes 411 of the body 41 of the direction control member 40, so that the direction control member 40 may be positioned at two different positions. The body 41 of the direction control member 40 is formed with two guide tracks 412 each rested on the guide portion 303 of each of the two directional blocks 30.

Figure 4:
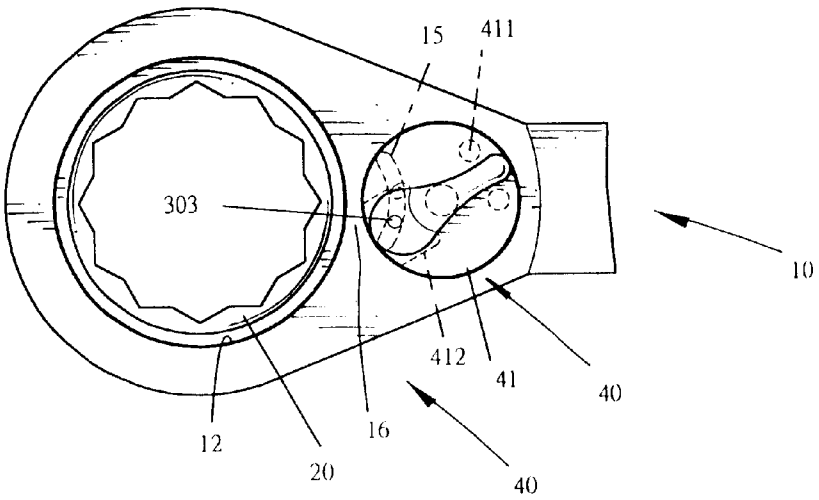
FIG. 4 is a top plan operational view of the wrench structure as shown in FIG. 2.
Figure 5:
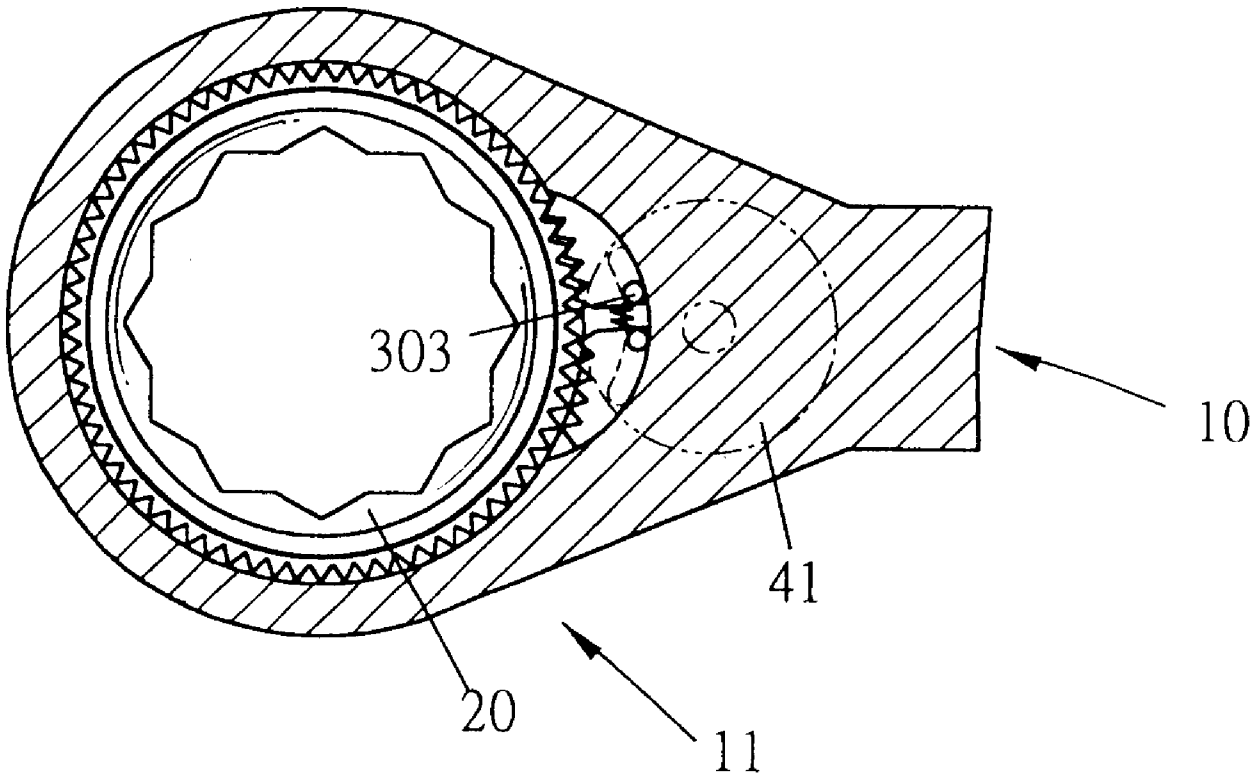
FIG. 5 is a cross-sectional view of the wrench structure as shown in FIG. 4.

Thus, as shown in FIGS. 4 and 5, when the body 41 of the direction control member 40 is rotated, each of the guide tracks 412 may be deflected and moved. Thus, the guide portion 303 of one of the two directional blocks 30 is moved by the respective guide track 412 of the body 41 of the direction control member 40, so that one of the two directional blocks 30 may be pivoted and deflected toward one side of each of the guide tracks 412, with the locking portion 301 meshing with the multiple ratchet teeth 201 of the drive body 20. Thus, the drive body 20 may be driven to rotate in a single direction by one of the two directional blocks 30.

Accordingly, the wrench structure in accordance with the present invention has the following advantages.

1. The end face of the drive head 11 of the wrench handle 10 is formed with a spacing portion 16 located between the receiving chamber 12 and the direction control recess 13 of the drive head 11 of the wrench handle 10. The spacing portion 16 of the drive head 11 of the wrench handle 10 is continuous extended and is not broken, so that the end face of the drive head 1 1 of the wrench handle 10 has a continuous structure, thereby efficiently preventing the stress from being concentrated on the portion between the receiving chamber 12 and the direction control recess 13 of the drive head 11 of the wrench handle 10, so that the structural strength of the drive head 11 of the wrench handle 10 may be relatively enhanced, thereby increasing the lifetime of the wrench structure.

2. Each of the two directional blocks 30 is guided by the arcuate guide slot 14 of the drive head 11 of the wrench handle 10. In addition, the guide portion 303 of each of the two directional blocks 30 is limited by the limit portion 15 of the direction control recess 13 of the drive head 11 of the wrench handle 10, and is guided by the respective guide track 412 of the body 41 of the direction control member 40. Thus, movement of each of the two directional blocks 30 is limited exactly, so that each of the two directional blocks 30 may be moved in the arcuate guide slot 14 of the drive head 11 of the wrench handle 10 rigidly and stably, and will not be improperly deflected toward the drive body 20. Thus, each of the two directional blocks 30 may be locked with the drive body 20 exactly, so that the drive body 20 may be operated rigidly and stably.

The wrench structure as shown in FIGS. 1–5 is available for a close-ended ratchet wrench.

Figure 6:
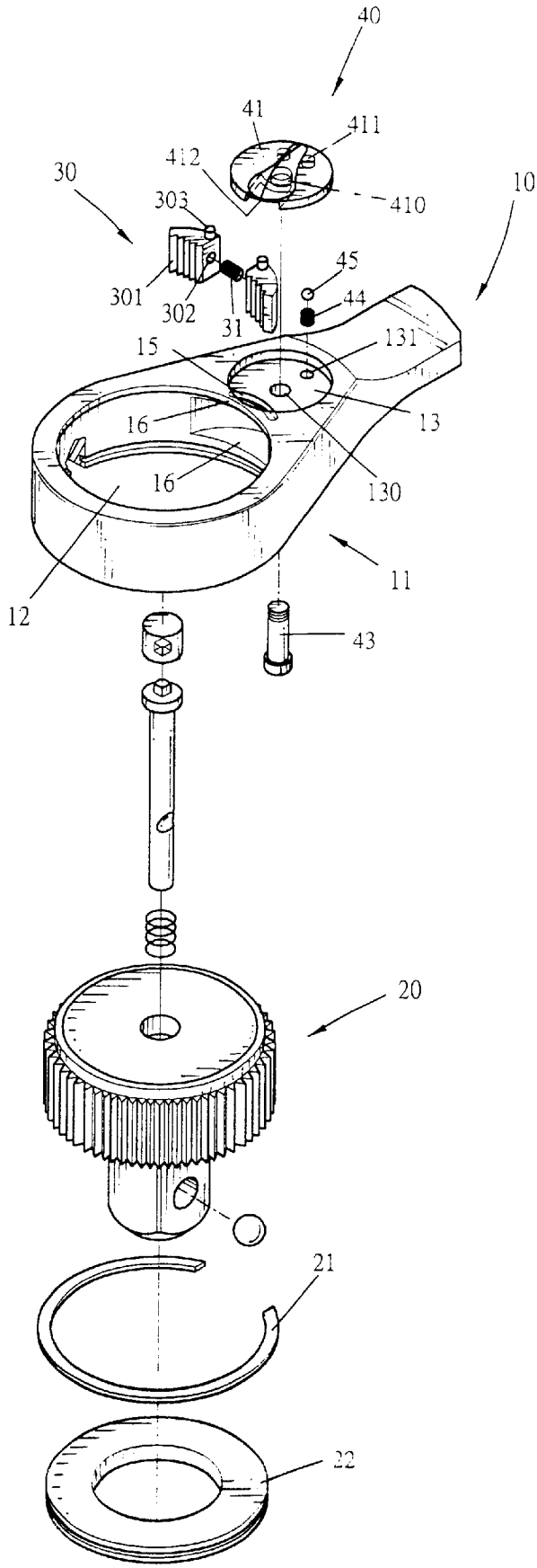
FIG. 6 is an exploded perspective view of a wrench structure in accordance with another embodiment of the present invention.

The wrench structure as shown in FIG. 6 is available for a socket ratchet wrench.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wrench structure, comprising a wrench handle, a drive body, two directional blocks, and a direction control member, wherein:

the wrench handle has a distal end provided with a drive head, the drive head is formed with a receiving chamber and a guide slot communicating with the receiving chamber, the drive head has an end face formed with a direction control recess and a spacing portion located between the receiving chamber and the direction control recess, the direction control recess has a bottom wall formed with a limit portion communicating with the guide slot;

the drive body is mounted in the receiving chamber of the drive head of the wrench handle;

each of the two directional blocks is pivotally mounted in the guide slot of the drive head of the wrench handle and is provided with a protruding guide portion extended through the limit portion and extended into the direction control recess; and the direction control member is rotatably mounted in the direction control recess of the drive head of the wrench handle and is rested on the guide portion of each of the two directional blocks, for pivoting and moving each of the two directional blocks in the guide slot of the drive head of the wrench handle.

2. The wrench structure in accordance with claim 1, wherein the drive body has an outer wall provided with multiple ratchet teeth, and each of the two directional blocks has one side provided with a tooth-shaped locking portion that may mesh with the multiple ratchet teeth of the drive body.

3. The wrench structure in accordance with claim 1, wherein the spacing portion of the drive head of the wrench handle is continuous extended between the receiving chamber and the direction control recess and is not broken.

4. The wrench structure in accordance with claim 1, wherein the guide slot is located between the receiving chamber and the direction control recess of the drive head of the wrench handle.

5. The wrench structure in accordance with claim 1, further comprising an elastic push member mounted between the two directional blocks.

6. The wrench structure in accordance with claim 5, wherein each of the two directional blocks has one end formed with a receiving hole for receiving the elastic push member.

7. The wrench structure in accordance with claim 1, wherein the direction control recess of the drive head of the wrench handle is formed with a central hole, the direction control member is formed with a fixing hole, and a fixing bolt is extended through the central hole of the direction control recess of the drive head of the wrench handle, and is secured in the fixing hole of the body of the direction control member, so that the direction control member is rotatably mounted in the direction control recess of the drive head of the wrench handle.

8. The wrench structure in accordance with claim 1, wherein the direction control member has a periphery formed with two spaced positioning holes, the direction control recess of the drive head of the wrench handle has a periphery formed with a receiving hole for receiving an elastic member and a positioning member which is pushed by the elastic member and is locked in one of the two spaced positioning holes of the body of the direction control member.

9. The wrench structure in accordance with claim 1, wherein the direction control member is formed with two guide tracks each rested on the guide portion of each of the two directional blocks, for guiding and moving the guide portion of each of the two directional blocks in the guide slot of the drive head of the wrench handle.

* * * * *

US006691594C1

(12) EX PARTE REEXAMINATION CERTIFICATE (6194th)

United States Patent

Chen

(10) Number: US 6,691,594 C1

(45) Certificate Issued: Apr. 15, 2008

(54) WRENCH STRUCTURE

(76) Inventor: Terence Chen, No. 325 Yungching Road, Dungshan Shiang Ilan (TW)

Reexamination Request:
No. 90/008,116, Jul. 19, 2006

Reexamination Certificate for:

| | |
|---|---|
| Patent No.: | **6,691,594** |
| Issued: | **Feb. 17, 2004** |
| Appl. No.: | **10/189,487** |
| Filed: | **Jul. 8, 2002** |

(51) Int. Cl.
*B25B 13/00* (2006.01)
*B25B 13/46* (2006.01)

(52) U.S. Cl. ..... 81/61; 81/62

(58) Field of Classification Search ..... None
See application file for complete search history.

(56) References Cited

FOREIGN PATENT DOCUMENTS

DE 29915837 U1 1/2000

GB 2353746 A 3/2001

*Primary Examiner*—David O. Reip

(57) ABSTRACT

A wrench structure includes a wrench handle, a drive body, two directional blocks, and a direction control member. The wrench handle has a drive head formed with a receiving chamber for mounting the drive body and a guide slot for mounting each of the two directional blocks. The drive head has an end face formed with a direction control recess and a spacing portion located between the receiving chamber and the direction control recess, for enhancing the structural strength of the wrench handle. The direction control recess is formed with a limit portion for limiting and guiding each of the two directional blocks, so that each of the two directional blocks may be moved to a determined position exactly, thereby changing the direction of operation of the wrench handle and the drive body actually.

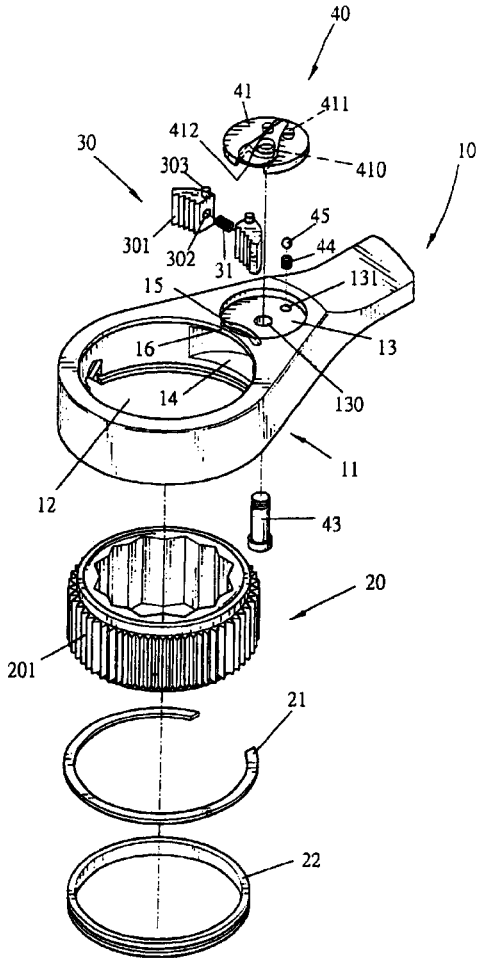

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–9 is confirmed.

* * * * *